US010820716B1

(12) United States Patent
Antinori et al.

(10) Patent No.: US 10,820,716 B1
(45) Date of Patent: Nov. 3, 2020

(54) DUAL SIDED INNERSPRING MATTRESS

(71) Applicants: Steven J. Antinori, Tampa, FL (US); Bill Frame, Valrico, FL (US); Jon Studner, Rockville, MD (US)

(72) Inventors: Steven J. Antinori, Tampa, FL (US); Bill Frame, Valrico, FL (US); Jon Studner, Rockville, MD (US)

( * ) Notice: Subject to any disclaimer, the term of this patent is extended or adjusted under 35 U.S.C. 154(b) by 371 days.

(21) Appl. No.: 15/530,312

(22) Filed: Dec. 20, 2016

(51) Int. Cl.
*A47C 27/06* (2006.01)
*A47C 27/22* (2006.01)

(52) U.S. Cl.
CPC ..... *A47C 27/062* (2013.01); *A47C 27/064* (2013.01); *A47C 27/22* (2013.01)

(58) Field of Classification Search
CPC ..... A47C 27/04; A47C 27/045; A47C 27/061; A47C 27/062; A47C 27/064; A47C 27/07; A47C 27/148; A47C 27/20; A47C 27/22; A47C 23/002; A47C 23/0433; A47C 23/0435; A47C 23/063; A47C 23/064; A47C 23/125; A47C 23/00
See application file for complete search history.

(56) References Cited

U.S. PATENT DOCUMENTS 871,871 A * 11/1907 Hirschman ..... A47C 27/062 267/92
1,703,587 A * 2/1929 Kraft ..... A47C 27/062 5/252
1,741,847 A * 12/1929 Kaspar ..... A47C 23/055 267/92
2,257,994 A * 10/1941 Zofnass ..... A47C 27/0456 5/696
2,461,062 A * 2/1949 Kane ..... A47C 27/063 5/720
6,256,820 B1 * 7/2001 Moser ..... A47C 27/062 267/166
6,353,952 B1 * 3/2002 Wells ..... A47C 27/062 5/716
6,397,418 B1 * 6/2002 Stjerna ..... A47C 27/062 5/655.8
6,523,812 B1 * 2/2003 Spinks ..... A47C 27/001 267/166
2004/0025256 A1 * 2/2004 Mossbeck ..... A47C 27/062 5/655.8
2004/0103479 A1 * 6/2004 Mossbeck ..... A47C 23/0433 5/720
2004/0128773 A1 * 7/2004 Barber ..... A47C 27/062 5/716
2005/0257323 A1 * 11/2005 Edling ..... B68G 9/00 5/720
2008/0184492 A1 * 8/2008 Sunde ..... A47C 27/053 5/717
2009/0018857 A1 * 1/2009 Rawls-Meehan ..... A47C 7/027 705/305

(Continued)

*Primary Examiner* — Robert G Santos
*Assistant Examiner* — Rahib T Zaman
(74) *Attorney, Agent, or Firm* — Arthur W Fisher, III

(57) ABSTRACT

A dual sided innerspring mattress including a first spring assembly having a first support surface formed by a first plurality of discrete zones with a first firmness profile to support an individual and a second spring assembly having a second support surface formed by a second plurality of discrete zones with a second firmness profile to support an individual of a greater height and body weight.

10 Claims, 6 Drawing Sheets

(56) References Cited

U.S. PATENT DOCUMENTS

| | | | | |
|---|---|---|---|---|
| 2011/0041252 | A1* | 2/2011 | DeFranks | A47C 27/064 5/655.8 |
| 2011/0191962 | A1* | 8/2011 | Frame | A47C 27/05 5/717 |
| 2014/0013505 | A1* | 1/2014 | Sportis | A47C 27/15 5/400 |
| 2015/0320229 | A1* | 11/2015 | Edling | A47C 23/0435 5/720 |
| 2015/0335163 | A1* | 11/2015 | Kilgore | A47C 27/148 5/718 |
| 2016/0157626 | A1* | 6/2016 | Grothaus | A47C 27/064 267/142 |
| 2016/0270546 | A1* | 9/2016 | Codos | A47C 27/064 |

* cited by examiner

DUAL SIDED INNERSPRING MATTRESS

BACKGROUND OF THE INVENTION

Field of the Invention

A dual sided innerspring mattress comprising a first spring assembly and a second spring assembly having different firmness profiles to support individuals of different height and body weight ranges for proper spinal alignment.

Description of the Prior Art

There is a wide range of mattresses and other supports for sleep and/or seating. A number of the more pertinent prior art documents are briefly described below.

US 2014/0096325 depicts a mattress having a first and second support surface configured to support a user where each support surface has a different level of firmness.

JP 2009131645 shows a dual sided mattress with different firmness levels. An array of first coil springs comprising a first coil spring layer and an array of the second coil springs comprising a second coil spring layer to create a dual firmness. US 2013/0081209 also discloses a dual sided mattress with different degrees of firmness.

U.S. Pat. No. 7,992,242 relates to a mattress including a head, torso and leg firmness zone.

US 2016/0029811 discloses a foam spring mattress including a plurality of foam springs forming patterns of varied firmnesses.

U.S. Pat. No. 6,353,952 describes a bedding product including a plurality of coil springs arranged in rows and columns divided into sections. The springs of one section are taller than the springs of another section. Filler is placed above the shorter springs in select sections. The taller springs are of a greater firmness than the filler material thus creating a posturized effect.

U.S. Pat. No. 6,813,791 shows a bedding product comprising a pocket spring assembly including a plurality of parallel rows or columns of springs joined to each other. Each of the rows or columns of springs comprises a plurality of interconnected pocket coil springs. The product has multiple sections of differing firmness attributable in part to differing heights of the pockets of the strings of springs. Filler is placed above the lower sections of the pocketed spring assembly.

US 2011/0191962 relates to a mattress including spring assembly comprising a plurality of first and second section of coils arranged in rows. The first section of coils are different in size from the second section of coils defining a plurality of zones of different firmness.

US 2002/0195756 depicts a spring coil assembly having a first row of coils arranged in a first spacing pattern and a second row of coils in a second spacing pattern creating areas of different firmness.

GB 2,215,199 describes a multiple zone mattress with different spacing of the support elements to vary the firmness of the different zones.

U.S. Pat. No. 6,295,676 shows a mattress with staggered rows of pocket springs disposed about the periphery of the interior supporting pocket springs.

U.S. Pat. No. 7,886,385 relates to a mattress including quilted zone panels with stitching of different spacing to produce zones of different firmness.

DE 3,321,720 depicts a padded foam support constructed of interlocking sections of foam material with different degrees of hardness.

U.S. Pat. No. 4,053,957 shows a multi-layered mattress including an upper and lower layer. The resiliency of the material in the upper layer is greater than that of the lower layer which when interlocked to create different zones of firmness.

Additional examples of the prior art are found in the following documents: U.S. Pat. Nos. 1,387,744; 2,049,551; 2,681,457; 3,083,380; 3,319,274; 3,769,643; 3,999,234; 4,862,540; 5,105,488; 5,231,717; 6,658,682; 7,574,762; 7,617,556; 8,176,589; 8,209,804; 8,341,786; 8,448,315; 8,832,889; 9,332,856; 9,380,883; US 2008/184492; US 2012/0180225; US 2016/0015185; US 2016/0157626; DE 3,236,714; EP 0,180,244; EP 1,364,602 and JP 2009-131,645.

While some of the prior art may contain some similarities relating to the present invention, none of them teach, suggested or include all of the advantages and unique features of the invention disclosed hereafter.

SUMMARY OF THE INVENTION

The present invention relates a dual sided innerspring mattress comprising a first support surface and a second support surface having different firmness profiles to support persons of different heights and body weights.

The dual sided mattress comprises a first spring assembly including the first support surface formed by a first plurality of discrete zones having a first firmness profile to support an individual and a second spring assembly including the second support surface formed by a second plurality of discrete zones having a second firmness profile to support an individual of greater height and body weight than the first support surface of the first spring assembly.

The first plurality of discrete zones comprises a proximal zone, an intermediate zone and a distal zone separated by a proximal support zone and a distal zone.

The second plurality of discrete zones comprises a proximal support zone, an intermediate support zone and a distal support zone separated by a proximal zone and a distal zone.

The various zones comprise multiple transverse rows of pocket springs extending transversely across substantially the width of the dual sided mattress.

The pocket springs of the various zones alternate between shorter heights and taller heights such that the first spring assembly and the second spring assembly interlock when the dual sided mattress is fully assembled.

When fully assembled, adjacent pocket springs within each zone and adjacent rows of pocket springs are secured together such that the first spring assembly and the second spring assembly are each utilized. In addition, the first spring assembly and the second spring assembly may be secured together.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

The present invention relates a dual sided innerspring mattress comprising a first support surface and a second support surface having different firmness profiles to support persons of different heights and body weights.

As shown in FIGS. 1, 3 and 5 through 7, the dual sided mattress generally indicated as 10 comprises a first spring assembly generally indicated as 12 including the first support surface generally indicated as 14 formed by a first plurality of discrete zones having a first firmness profile to support an individual and a second spring assembly generally indicated as 16 including the second support surface 18 formed by a second plurality of discrete zones having a second firmness profile to support an individual of greater height and body weight than the first support surface 14 of the first spring assembly 12.

The first plurality of discrete zones comprises a proximal zone, an intermediate zone and a distal zone generally indicated as 20, 22 and 24 respectively separated by a proximal support zone and a distal support zone generally indicated as 26 and 28 respectively.

The second plurality of discrete zones comprises a proximal support zone, an intermediate support zone and a distal support zone generally indicated as 30, 32 and 34 respectively separated by a proximal zone and a distal zone generally indicated as 36 and 38 respectively.

Figure 2:
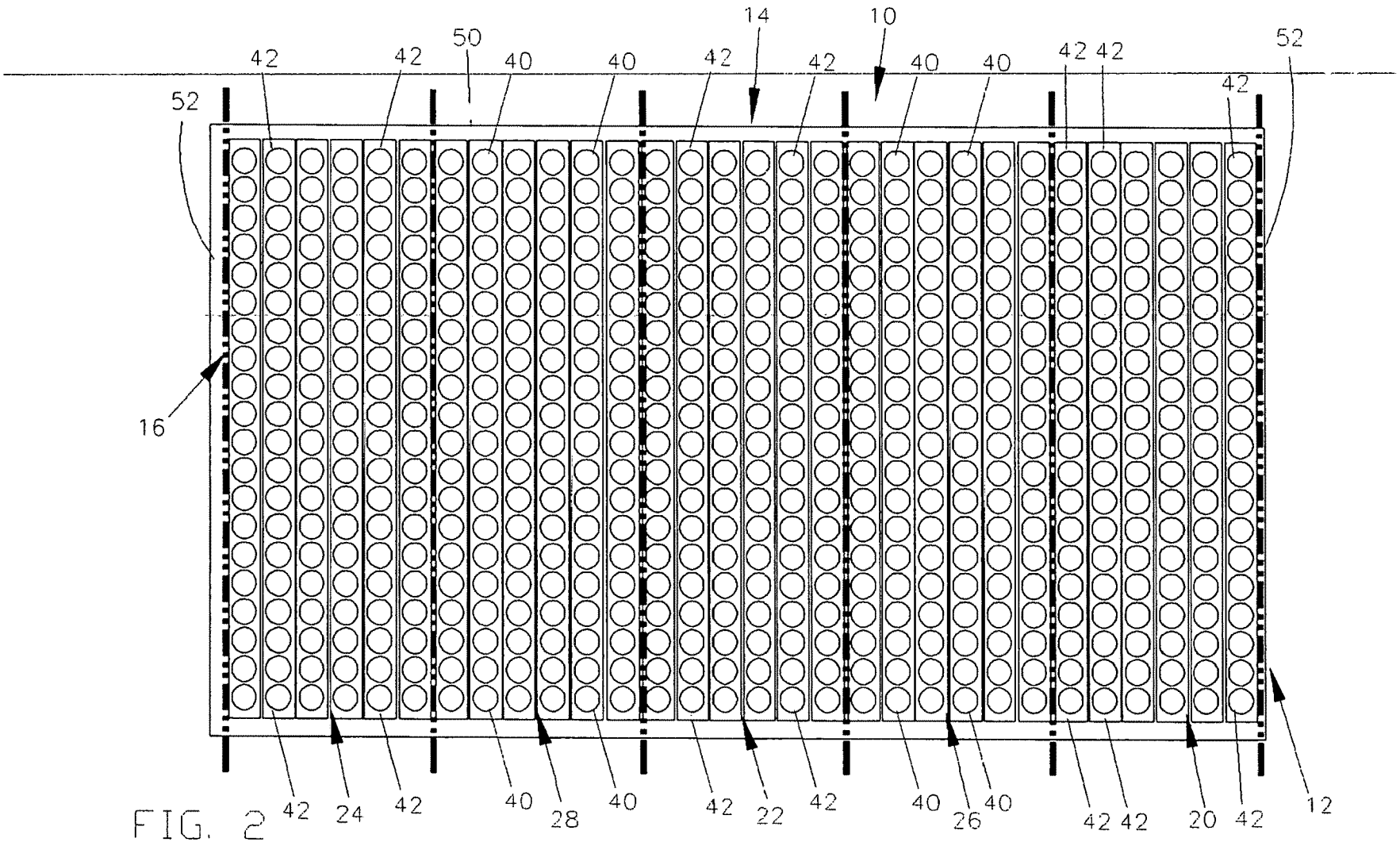
FIG. 2 is a top view of the dual sided mattress of the present invention depicted in FIG. 1.
Figure 4:
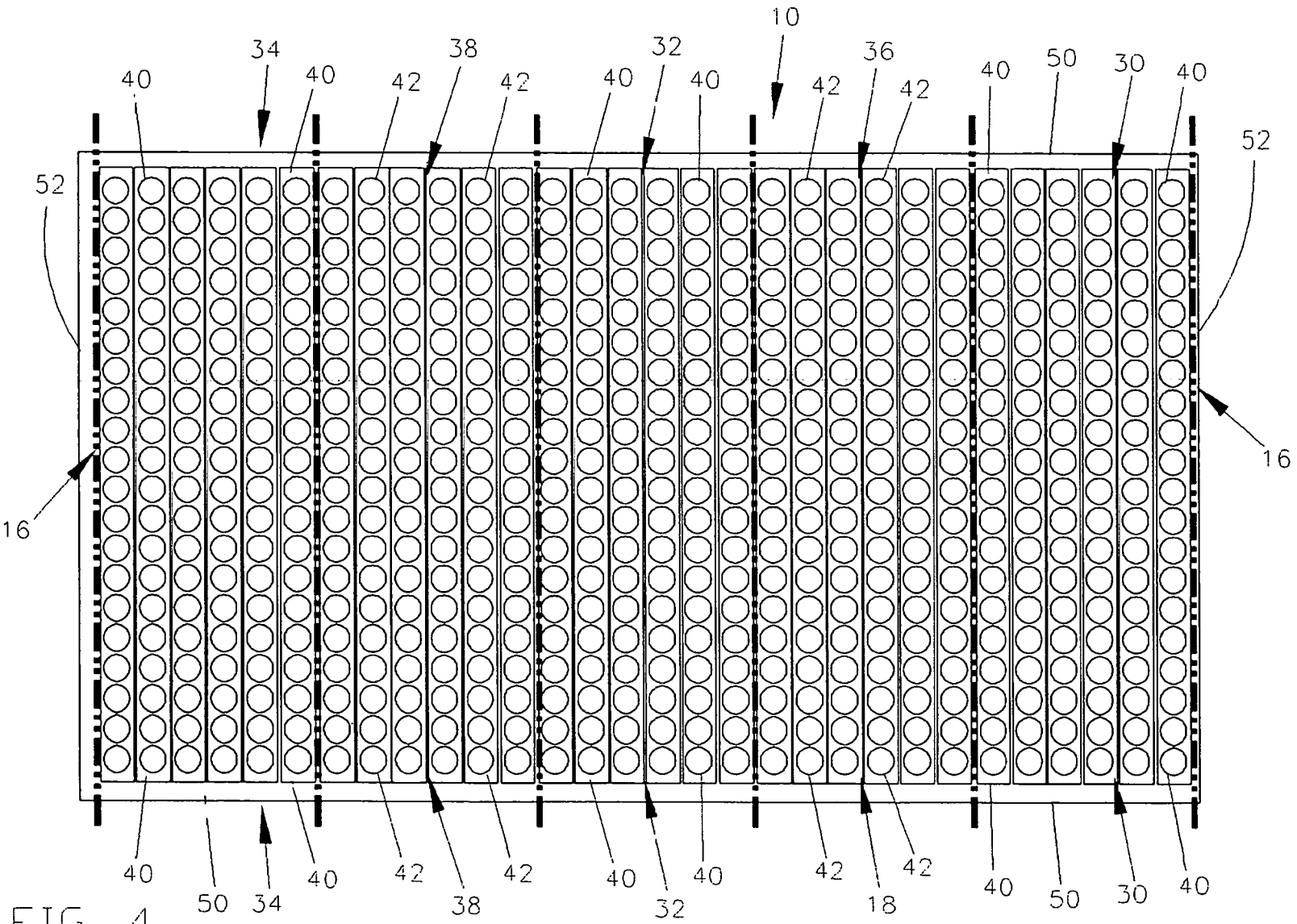
FIG. 4 is a top view of the dual sided mattress of the present invention depicted in FIG. 3.

The proximal support zone 26 and distal support zone 28 of the first plurality of zones and the proximal support zone 30, intermediate support zone 32 and distal support 32 and distal support zone 34 of the second plurality of zones each comprises multiple transverse rows 42 of pocket springs 40 extending transversely across substantially the width of the dual sided mattress 10 as shown in FIGS. 2 and 4.

The proximal zone 20, intermediate zone 22 and distal zone 24 of the first plurality of zones and the proximal zones 36 and 38 of the second plurality of zones each comprises multiple transverse rows 42 of pocket springs 40 extending transversely across substantially the width of the dual sided mattress 10 as shown in FIGS. 2 and 4.

As shown in FIGS. 1, 3 and 5 through 7, the pocket springs 40 of the support zones 26, 28, 30, 32 and 34 are shorter in height than the pocket springs 40 of zones 20, 22, 24, 36 and 38 such as about 3 inches and about 4 inches respectively.

Figure 5:
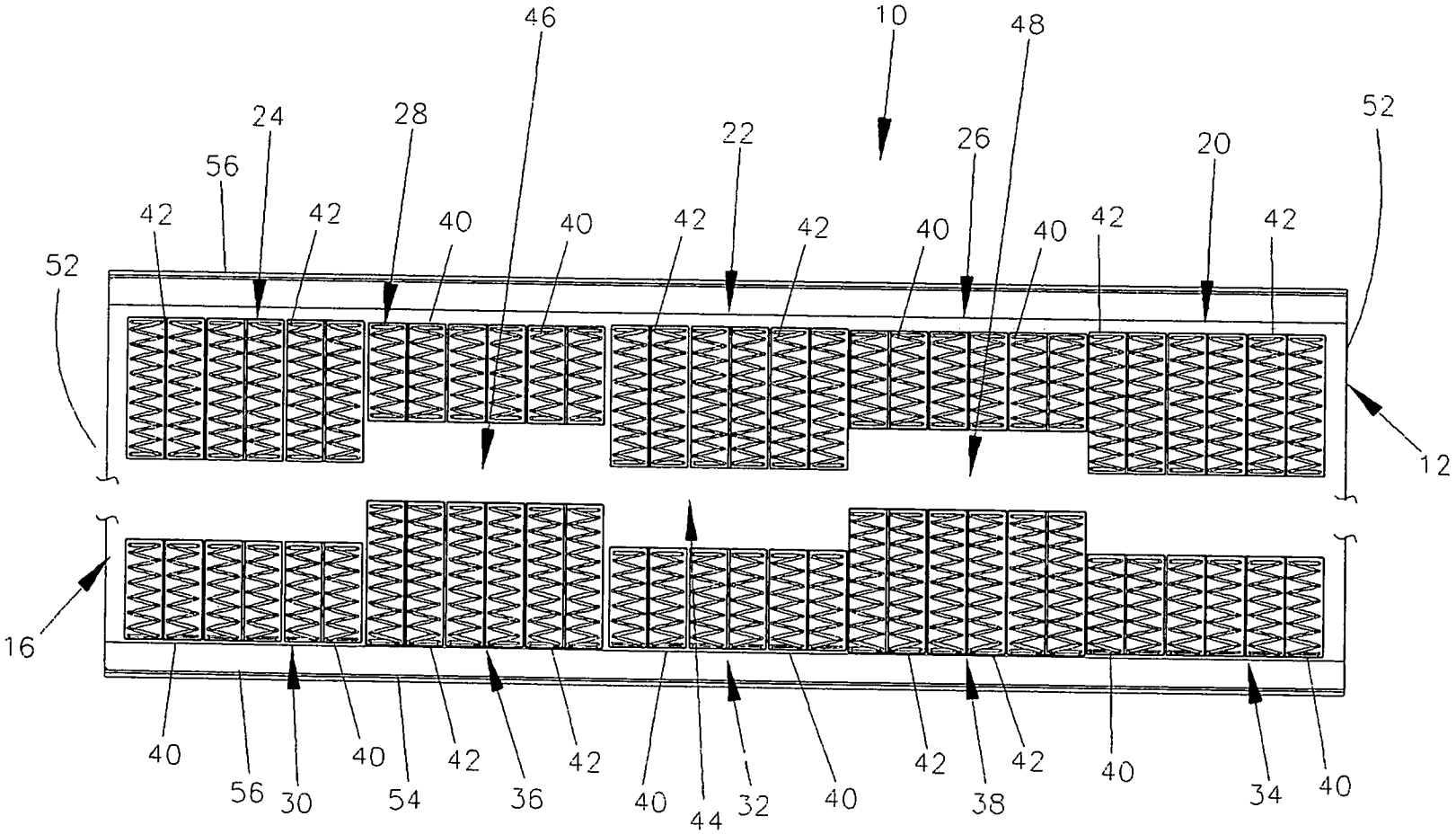
FIG. 5 is an exploded side view of the dual sided mattress of the present invention depicted in FIG. 1.
Figure 7:
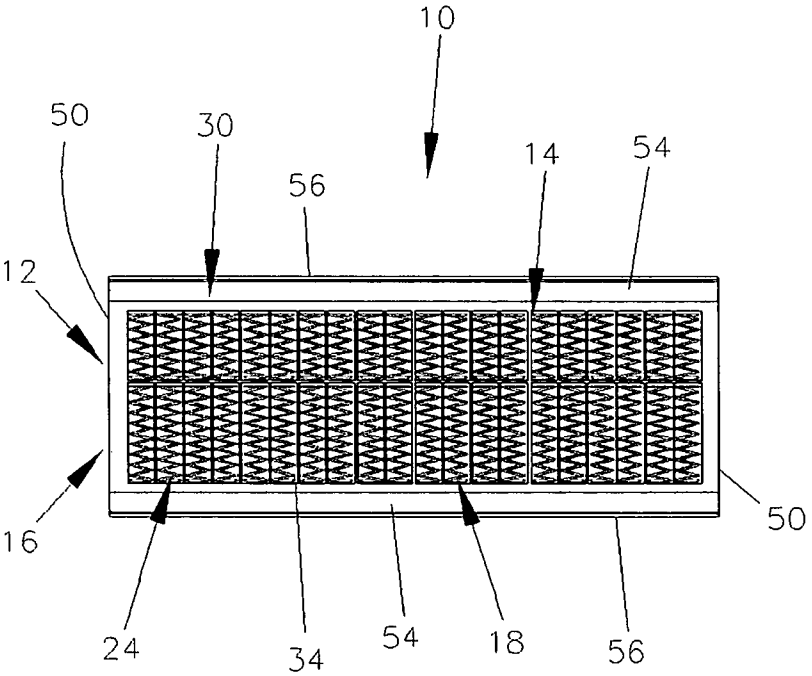
FIG. 7 is an end view of the dual sided mattress of the present invention depicted in FIG. 3.
Figure 6:
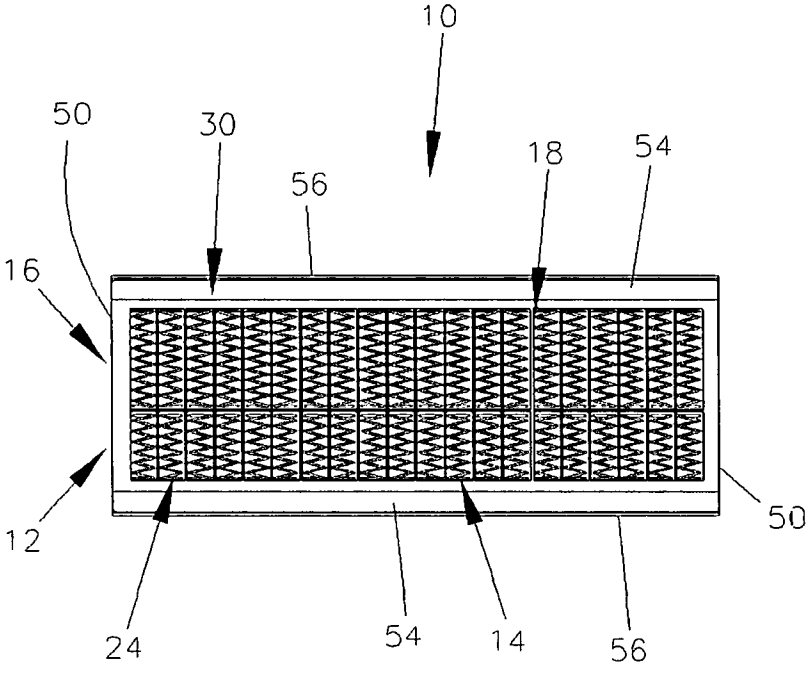
FIG. 6 is an end view of the dual sided mattress of the present invention depicted in FIG. 1.

As best depicted in FIG. 5, the proximal zone 20, proximal support zone 26, intermediate zone 22, distal support zone 28 and distal zone 24 of the first spring assembly substantially align vertically with the proximal support zone 30, proximal zone 36, intermediate support zone 32, distal zone 38 and distal support zone 34 of the second spring assembly 16 respectively to interlock the first spring assembly 12 and the second spring assembly 16 when the dual sided mattress 10 is fully assembled.

As shown in FIGS. 1, 3, 6 and 7, the first support surface 14 and the second support surface 18 are substantially parallel relative to each other.

Specifically as best shown in FIG. 5, the pocket springs of the intermediate zone 22 of the first spring assembly 12 extend into and seat in a recess or groove 44 formed between the proximal zone 36 and distal zone 38 of the second spring assembly 16; while, the proximal zone 36 and distal zone 38 of the second spring assembly 16 extend into and seat in recesses 46 and 48 respectively formed between the intermediate zone 22 and distal zone 24 and between the intermediate zone 22 and proximal zone 20 of the first spring assembly 12 respectively.

When assembled, the first spring assembly 12 and the second spring assembly 16 are disposed between a pair of side panels each indicated as 50 and a pair of end panels each indicated as 52.

An inner layer of foam 54 and an outer mattress layer of fabric or cover to encase 56 both the first spring assembly 12 and the second spring assembly 16.

Figure 1:
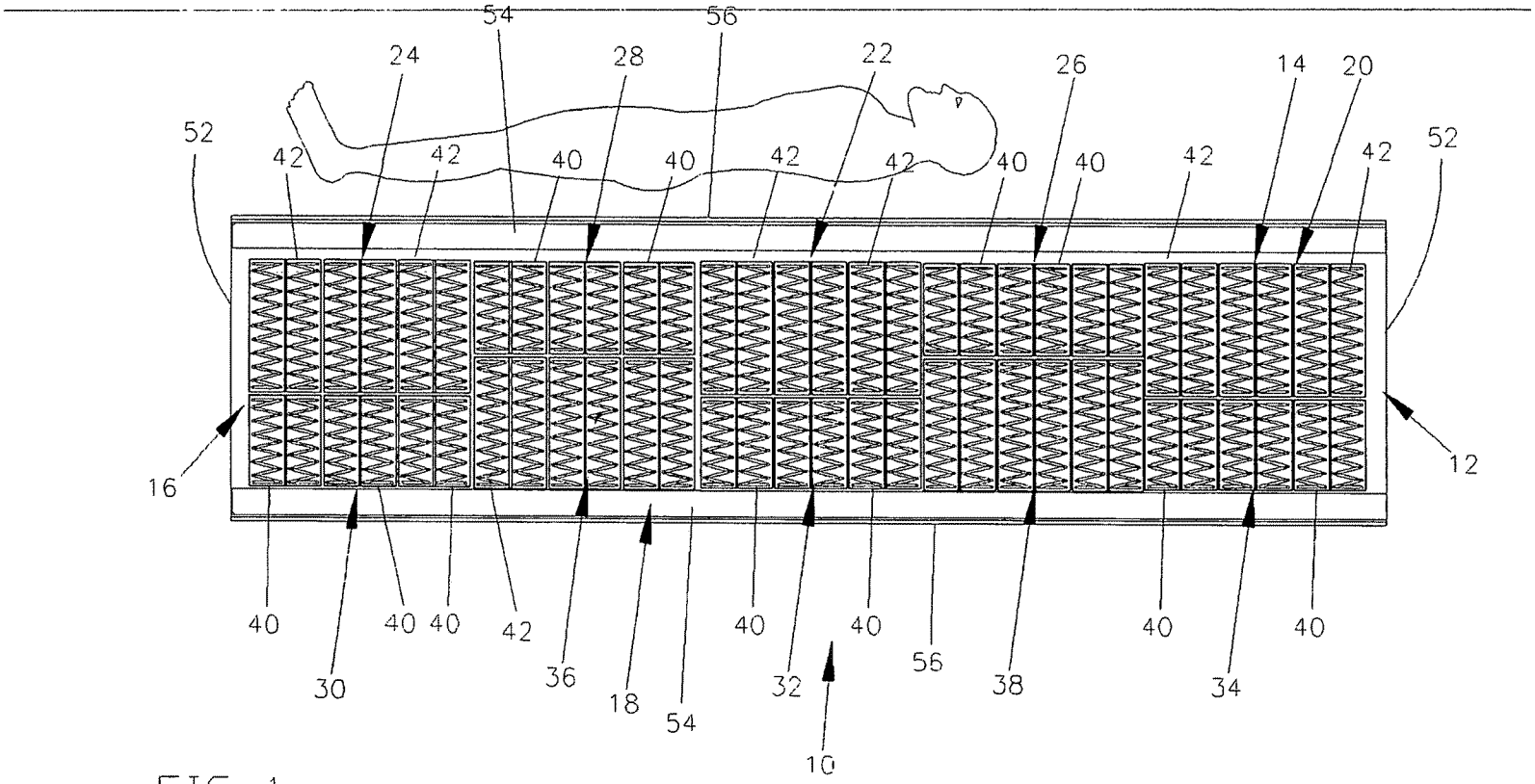
FIG. 1 is a side view of the dual sided mattress of the present invention showing the first spring assembly on top as the sleeping side.

As shown in FIG. 1, the proximal support zone 26 and the distal support zone 28 of the first support surface 14 support the shoulders and hips/buttocks of an individual respectively when the first spring assembly 12 is on top.

Figure 3:
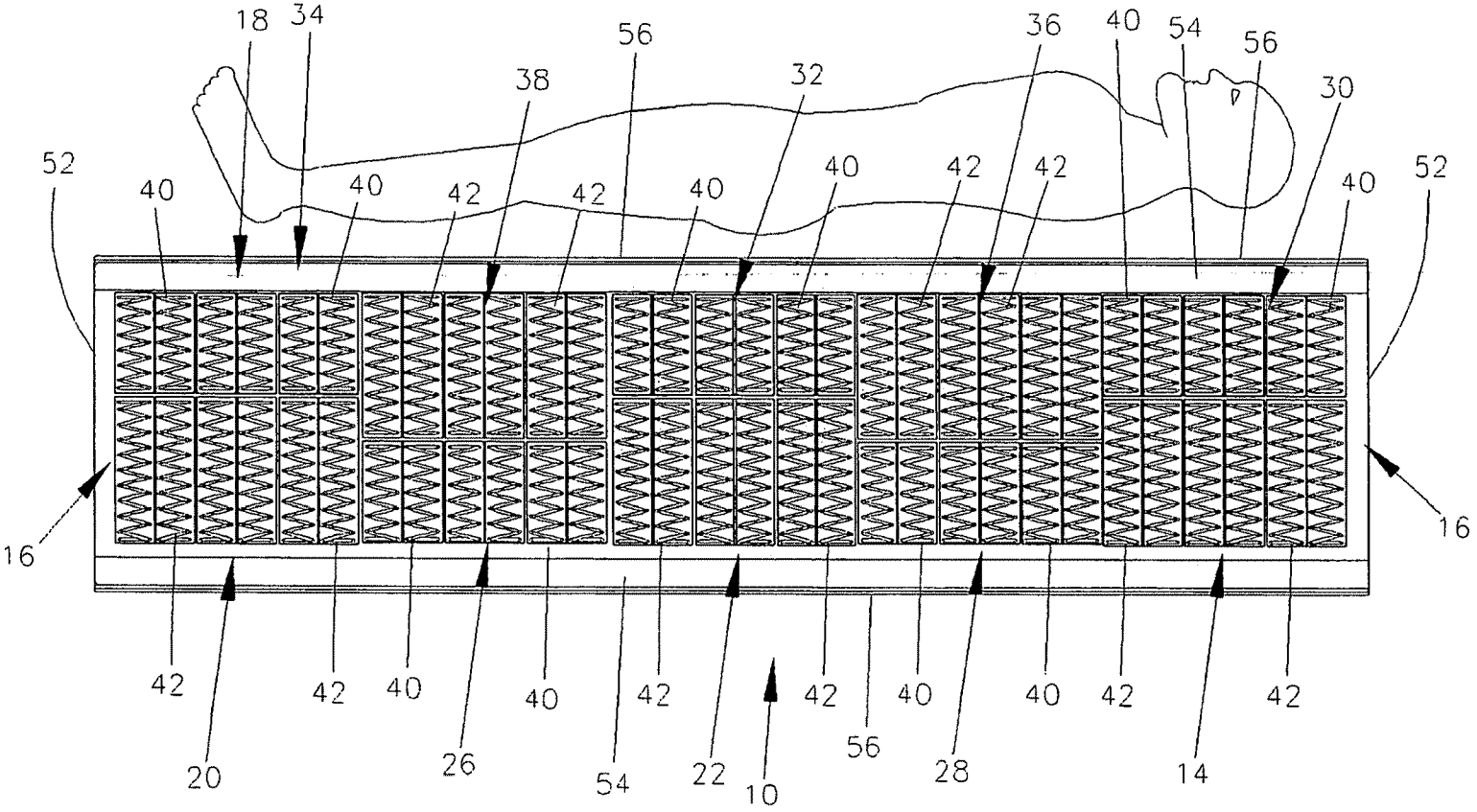
FIG. 3 is a side view of the dual sided mattress of the present invention showing the second spring assembly on top as the sleeping side.

As shown in FIG. 3, the proximal support zone 30, the intermediate support zone 32 and the distal support zone 34 of the second support surface 18 support the shoulders, hips/buttocks and feet respectively when the second spring assembly 16 is on top.

When fully assembled, adjacent pocket springs 42 within each zone and adjacent rows are secured together such that the first spring assembly 12 and the second spring assembly 16 are each utilized. In addition, the first spring assembly 12 and the second spring assembly 16 may be secured together with snaps, rings or wire or other suitable fasteners.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A dual sided innerspring mattress including a first spring assembly having a first support surface including a proximal support zone and a distal support zone formed by a first plurality of discrete zones to support an individual and a second spring assembly having a second support surface including a proximal support zone, an intermediate support zone and a distal support zone formed by a second plurality of discrete zones to support an individual of a greater height than said first support surface, said first support surface and said second support surface disposed on opposite sides of said dual sided innerspring mattress, said first support surface and said second support surface each being substantially flat and substantially parallel to each other, said first plurality of discrete zones comprises said proximal support zone and said distal support zone separated by an intermediate zone and said second plurality of discrete zones comprises proximal support zone and said intermediate support zone separated by a proximal zone and said distal support zone separated from said intermediate support zone by a distal zone wherein proximal support zone and said distal support zone of said first plurality of discrete zones each comprises a first plurality of rows of pocket springs of substantially equal height extending across substantially the width of said first support surface and said intermediate zone comprises a second plurality of rows of pocket springs of substantially equal height extending across substantially the width of said first support surface wherein said height of said proximal support zone and said distal support zone of said first support surface is less than said height of said intermediate zone of said first plurality of discrete zones, said plurality of rows of pocket springs of said proximal support zone and said distal support zone having a firmness to support the head and feet of a person respectively when said first support surface is facing up and wherein said proximal support zone, said intermediate support zone and said distal support zone of said second plurality of discrete zones each comprises a first plurality of rows of pocket springs of substantially equal height extending across substantially the width of said second support surface and said proximal zone and said distal zone each comprises a second plurality of rows of pocket springs extending across substantially the width of said second support surface wherein said height of said proximal support zone, said intermediate support zone and said distal support zone of said second support surface is less than said height of said proximal zone and said distal zone having a firmness to support the head, mid-portion and feet of a person respectively when said second support surface is facing up.

2. The dual sided innerspring mattress of claim 1 wherein said pocket springs of said proximal support zone and said distal support zone of said first plurality of discrete zones and said proximal support zone, said intermediate support zone and said distal support zone of said second plurality of discrete zones are shorter in height than said pocket springs of said intermediate zone of said first plurality of discrete zones and said proximal zone and said distal zone of said second plurality of discrete zone.

3. The dual sided innerspring mattress of claim 2 wherein, said proximal support zone, said intermediate zone, and said distal support zone of said first spring assembly substantially align vertically with said proximal zone, said intermediate support zone and said distal zone of said second spring assembly respectively to interlock said first spring assembly and said second spring assembly together when said dual sided mattress is fully assembled.

4. The dual sided innerspring mattress of claim 3 wherein said pocket springs of said intermediate zone of said first spring assembly extend into a recess formed between said proximal zone and said distal zone of said second spring assembly.

5. The dual sided innerspring mattress of claim 4 wherein adjacent pocket springs within each zone and adjacent rows are secured together such that said first spring assembly and said second spring assembly are each secured together.

6. The dual sided innerspring mattress of claim 5 wherein said first spring assembly and said second spring assembly are disposed between a pair of side panels and a pair of end panels.

7. The dual sided innerspring mattress of claim 6 further includes an inner layer of foam and an outer mattress layer of fabric or cover to encase said first spring assembly and said second spring assembly.

8. The dual sided innerspring mattress of claim 7 wherein said first support surface and said second support surface are substantially parallel relative to each other.

9. The dual sided innerspring mattress of claim 4 wherein said proximal support zone, said intermediate zone and said distal support zone of said first spring assembly substantially align vertically with said proximal zone, said intermediate support zone and said distal support zone of said second spring assembly respectively to interlock said first spring assembly and said second spring assembly when said dual sided mattress is fully assembled.

10. The dual sided innerspring mattress of claim 1 wherein said proximal support zone and said distal support zone of said first plurality of discrete zones support the shoulders and hips/buttocks of an individual respectively when reclining on said first support surface and said proximal support zone, said intermediate support zone and said distal support zone support the shoulders, hips/buttocks and feet of an individual respectively when reclining on said second support surface.

* * * * *